US007621468B2

(12) United States Patent
Smith et al.

(10) Patent No.: US 7,621,468 B2
(45) Date of Patent: Nov. 24, 2009

(54) SYSTEM FOR PRESSURIZED DELIVERY OF FLUIDS

(75) Inventors: Scott Edward Smith, Cincinnati, OH (US); William Michael Cannon, West Harrison, IN (US); Wim Wintmolders, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 71 days.

(21) Appl. No.: 11/906,241

(22) Filed: Oct. 1, 2007

(65) Prior Publication Data

US 2009/0084870 A1 Apr. 2, 2009

(51) Int. Cl.
*B05B 1/34* (2006.01)
*B65D 83/28* (2006.01)

(52) U.S. Cl. ..... 239/492; 239/337; 239/463; 222/402.15

(58) Field of Classification Search ..... 239/337, 239/399, 403, 461, 463, 468, 476, 491–494, 239/569; 222/402.1, 402.15
See application file for complete search history.

(56) References Cited

U.S. PATENT DOCUMENTS 3,570,770 A 3/1971 Ewald
4,071,196 A 1/1978 Burke et al.
4,322,037 A * 3/1982 Heeb et al. ..... 239/337

FOREIGN PATENT DOCUMENTS

EP 0 479 796 B1 8/1993
WO WO 2004/062813 A1 7/2004

OTHER PUBLICATIONS

International Search Report, Feb. 6, 2009.

* cited by examiner

*Primary Examiner*—Darren W Gorman
(74) *Attorney, Agent, or Firm*—Larry L. Huston; Kim W. Zerby

(57) ABSTRACT

A pressurized spray system. The spray system has a flow path through which contents must pass to be dispensed from the system to the atmosphere. By maintaining the proper proportions of restrictions in the flow path to the spray nozzle exit orifice, a relatively constant mean particle size distribution may be obtained throughout the life of the spray system as the pressure decays.

16 Claims, 8 Drawing Sheets

FIG. 2
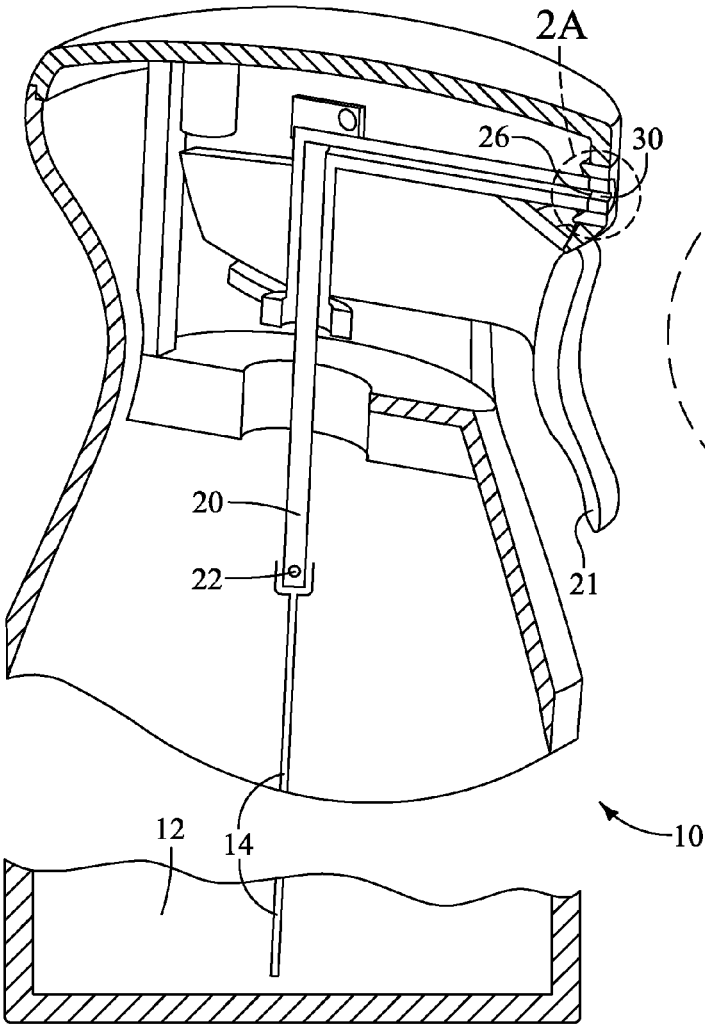
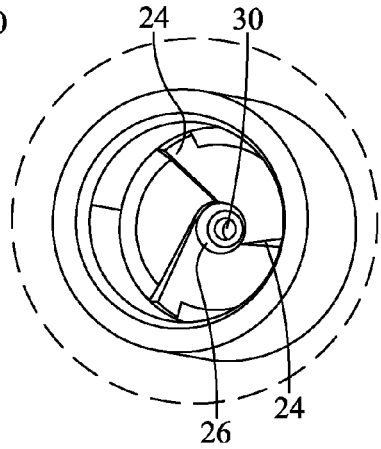
FIG. 2A

SYSTEM FOR PRESSURIZED DELIVERY OF FLUIDS

FIELD OF THE INVENTION

The present invention relates to systems which deliver liquids and more particularly for systems which deliver liquids under pressure.

BACKGROUND OF THE INVENTION

Spray systems, particularly pressurized spray systems, are well-known in the art. Such spray systems often utilize a metal can, plastic container or other package charged with a propellant. The propellant pressurizes the contents of the spray system to a pressure greater than atmospheric. Upon release of the propellant pressurizing the contents of the package, the pressure differential causes discharge of the contents to the atmosphere or ambient surroundings.

Typical propellants include compressed gasses, such as nitrogen, or hydrocarbon such as butane. One characteristic common to both compressed gas and hydrocarbon propellants is that the pressure decays with repeated uses, as illustrated. Such pressure decay may transmogrify the delivery characteristics of the contents of the package. However, the pressure decay of a compressed gas system is typically more noticeable throughout the life of the system. In contrast, hydrocarbon systems tend to regenerate, providing a generally more consistent pressure throughout much of the system life. Thus, only compressed gas systems are considered below.

Typical products contained in such packages include cleaners, furniture polish, perfumes, room deodorizers, spray paint, insecticides, lubricants, hair spray, medicine, etc. Each of these products has a desirable range of delivery characteristics, such as flow rate, cone angle and particle size. The flow rate is the amount of product delivered per unit time. The cone angle is the dispersion of the product over a particular area at a particular distance. The particle size is the distribution of average droplet size upon contacting the target surface or ambient at a predetermined distance from the nozzle orifice.

However, over time, the pressure decay of the propellant causes each of these delivery characteristics to change. The user may be able to compensate for some of these changes. For example, as the delivery rate decreases, the user may be able to simply dispense for a longer period of time. Likewise, as the cone angle decreases the consumer may be able to simply sweep the product over a larger area during dispensing or adjust the distance to the target surface.

However, as particle size increases during the pressure decay, the user is not able to compensate. An increase in particle size may be undesirable. For example, as particle size of a hairspray increases, the polymer may become too sticky. As particle size of a furniture polish increases, the polish may smear upon application. Particle size may also affect perfume release or suspension.

Accordingly, there is a need in the art to decouple couple particle size from the number of uses over the life of a product dispensed from a spray system. Some attempts have already been made in the art. For example EP 0,479,796 B1 issued to Pool et al. suggests that having a flow area ratio between the valve port and actuator outlet of at least 2:1 provides advantageous flow characteristics. However, some ratios less than 2:1 have been found to work well while some ratios greater than 2:1 have been found unsuitable. Accordingly, another approach is necessary.

SUMMARY OF THE INVENTION

A package for dispensing contents therefrom over a predetermined pressure range and comprising a reservoir for containing product, a valve stem being movable between a closed first position and an open second position, and having an upstream flow restriction therein, one or more tangentials for receiving product from said valve stem, said tangentials having a combined tangential flow area, wherein the ratio of the combined flow area of the tangentials to the upstream flow restriction ranges from 0.8-7.5 and a nozzle for dispensing contents from said container to the ambient.

BRIEF DESCRIPTION OF THE DRAWINGS

FIG. 2 is a vertical sectional view taken along the lines 2-2 of FIG. 1 and partially rotated for clarity.

FIG. 2A is a perspective view of the tangentials in the flow path of a package, as taken from the partial view in FIG. 2 and partially rotated for clarity.

In FIGS. 3A-3C and 4A-4*c*, A1 represents the area of the upstream flow restriction, as may be taken at the valve port(s), A2 represents the flow area of the tangentials, and the A1/A2 ratio represents the ratio of A1 to A2 at the particular point represented on the graph.

DETAILED DESCRIPTION OF THE INVENTION

Figure 1:
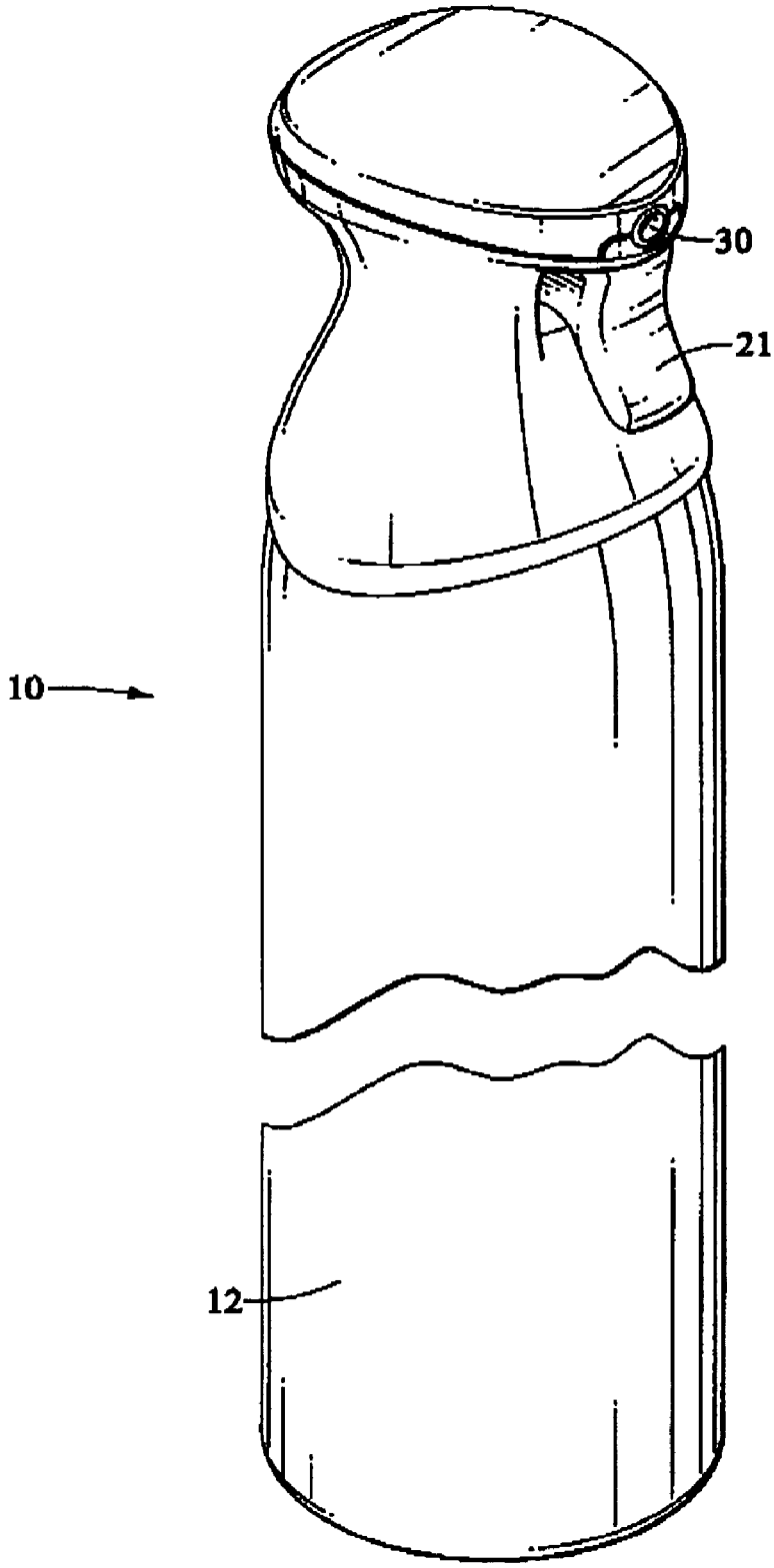
FIG. 1 is a perspective view of an exemplary spray package according to the present invention.

Referring to FIG. 1, a typical dispensing system comprises a package 10. Contents to be dispensed and a propellant are contained in the package 10. The contents and propellant may be intermixed at an interface or may be kept separate, using an inflatable bag, as are known in the art.

Referring to FIG. 2, the contents are dispensed in a sequential flow path. While many executions of a flow path from storage in the package 10 to spray to the atmosphere/ambient are known, one illustrative embodiment will be described herein. However, one of skill will recognize the invention is not so limited.

The contents to be dispensed are contained in a reservoir 12 and may enter the flow path through a dip tube 14. The dip tube 14 may be of constant or variable cross section. If the dip tube 14 has a variable cross section, the portion of the dip tube 14 having the greatest flow restriction (smallest flow area/hydraulic radius) is considered. If the dip tube 14 has a constant cross-section, the area of the dip tube 14 at the inlet is considered.

The contents to be dispensed exit the dip tube 14 and enter a headspace. The headspace is generally a relatively large portion of the flow path and does not typically provide significant flow restriction. From the headspace the contents to be dispensed enter a valve stem 20. The valve stem 20 is part of a movable assembly, which starts/stops the dispensing process upon moving from a first position to a second position. Typically, the user depresses the valve stem 20 to an open position to begin dispensing. The user then releases the valve stem 20, allowing it to return to a closed position in order to stop dispensing. The valve stem 20 may be spring-loaded, or otherwise biased, to allow it to return from the open position to the closed position. The valve stem may be actuated by a push button or trigger 21.

The dispensing system may have a longitudinal axis. Often, the valve stem 20 is parallel, and in a degenerate case, coincident, the longitudinal axis of the dispensing system. The contents to be dispensed may enter the valve stem 20, transverse, and typically radial to, the longitudinal axis. Entrance to the valve stem 20 may be through one, two, or more valve ports 22. If the valve stem 20 has multiple valve ports 22, the combined flow area of all valve ports 22 is considered. A common commercially available system has two equally sized valve ports 22 spaced 180 degrees apart.

Referring to FIG. 2A, the contents may then leave the valve stem 20 and enter one or more tangentials 24. The tangentials 24 are the portion(s) of the flow path disposed between the stem outlet and the swirl chamber 26. The tangentials 24 may be equally circumferentially spaced around the swirl chamber 26. A typical configuration has three tangentials 24 spaced 120° apart and oriented perpendicular to the exit orifice of the spray nozzle 30.

The swirl chamber 26 provides for intermixing of the product to be dispensed and air. Such intermixing helps to atomize the product prior to discharge. The swirl chamber 26 is the portion of the flow path disposed immediately before the outlet nozzle 30. The swirl chamber 26 does not present a significant restriction to the flow path.

Turbulent conditions within the swirl chamber 26 draw in ambient air, which intermix with the contents to be dispensed. The contents are finally dispensed to the atmosphere from an exit orifice in the spray nozzle 30. The exit orifice presents yet another, and final, flow restriction in the flow path.

The spray system according to the present invention may have a product volume of at least 30, 60 or 90 ml, but less than 1000, 800 or 600 ml. The propellent may provide a gage pressure of at least 1, 2, or 3 kg/square centimeters, and less than 12, 10 or 8 kg/square centimeters. Of course one of ordinary skill will recognize that the system of the present invention may have an initial pressure greater than that claimed herein below, and pass through the pressure range claimed herein below with efficacious results throughout the claimed pressure range.

For typical consumer product contents sprayed in ordinary household use, the contents may be sprayed in a generally circular pattern having a diameter of at least 6, 8 or 10 cm and less than 35, 30 or 25 cm. For typical consumer product contents sprayed in ordinary household use, the contents may be sprayed in a generally circular pattern having a cone angle of at least 20, 25 or 30 degrees and less than 150, 120, 90, 70 or 50 degrees.

The typical consumer product may be discharged at a spray rate of at least 1, 2 or 3 grams per second, and less than 25, 20 or 15 grams per second. The spray system of the present invention may be used with a product comprising an oil-in-water emulsion, having a density of approximately one and a total solids of about seven percent, and approximately seven percent emulsified polydimethelsiloxane oils. The product may have a flat viscosity of about 20 Pa·s until a shear of about 0.3 inverse seconds and a shear thinning behavior for all increasing shear rates above 0.3 inverse seconds, passing through 10 pa-s at a shear rate of 1 inverse second, and 0.5 Pa·s at a shear rate of 30 inverse seconds. DC 200, available from Dow Corning, of Midland Mich., has been found suitable for the spray systems of the present invention.

The product contents may have a particle size distribution, which yields a Sautern mean diameter of at least 40, 45, 50, 55 or 60 microns and less than 100, 90, 80 or 70 microns. Particle size may be measured using a spray particle analyzer available from Malvern Instruments, Ltd. of Worcestershire, United Kingdom.

Referring to FIGS. 3A-3C, and 4A-4C, surprisingly it has been found that when certain restrictions within the flow path are arranged in proper proportions, de-coupling of the particle size of the contents sprayed from the package 10 and the gage pressure within the package 10 may occur.

Referring back to FIGS. 2-2A, and more particularly, the spray nozzle 30 may be selected to have an exit orifice with a flow area of at least, 0.026, 0.027 or 0.028 and less than 0 0.032, 0.031 or 0.030 square millimeters. A round nozzle 30 having an area of 0.029 square millimeters has been found suitable. The system may be provided with a upstream flow restriction in the flow path defined by a flow area of at least 0.002, 0.004 or 0.006 square millimeters and less than 0.018, 0.016 or 0.014 square millimeters.

The upstream flow restriction is defined as the smallest flow area the contents must pass through prior to the tangentials 24 and nozzle 30 to be discharged from the package 10 to the ambient. If a portion of the flow path has parallel channels, the cumulative area of all parallel channels is considered in determining the area, and hence upstream flow restriction, of the flow path. For a typical system according to the present invention, the upstream flow restriction may occur at the valve ports 22, although the invention is not so limited. For the embodiments described herein, the area providing the upstream flow restriction is circular in shape and is provided by two equally sized flow areas taken in parallel, although the invention is not so limited.

One of ordinary skill will recognize that flow resistance may be provided independent of area. For example, flow resistance may be provided using bends, surface finish, hydraulic radius, and other physical parameters which affect boundary layer, etc Referring back to FIG. 2A, the tangentials 24 provide a combined tangential flow area, when the flow areas of all parallel tangentials 24 are cumulatively considered. The tangential flow area may be at least 0.001, 0.002 or 0.003 square millimeters, and less than 0.008, 0.007 or 0.006 square millimeters. The tangential flow area may be obtained by molding, assembly of the valve actuator by insertion to the proper dimensions, or drilling.

As the area of the exit orifice of the spray nozzle 30 increases, the tangential flow area may likewise increase. This proportional relationship provides a flow area ratio between the maximum flow restriction area and the tangential flow area of at least 0.5, 1.0 or 1.5 and less than 8, 7 or 6. Surprisingly, it has been found the ratio of flow areas between the tangentials 24 and the spray nozzle 30 has more effect on particle size than other flow path characteristics described in the literature.

Referring back to FIGS. 3A-3C and 4A-4C, it is apparent that combining certain ratios of flow areas with certain propellant pressure unexpectedly yields relatively consistent particle sizes over a usable range of propellant pressures.

Figure 3A:
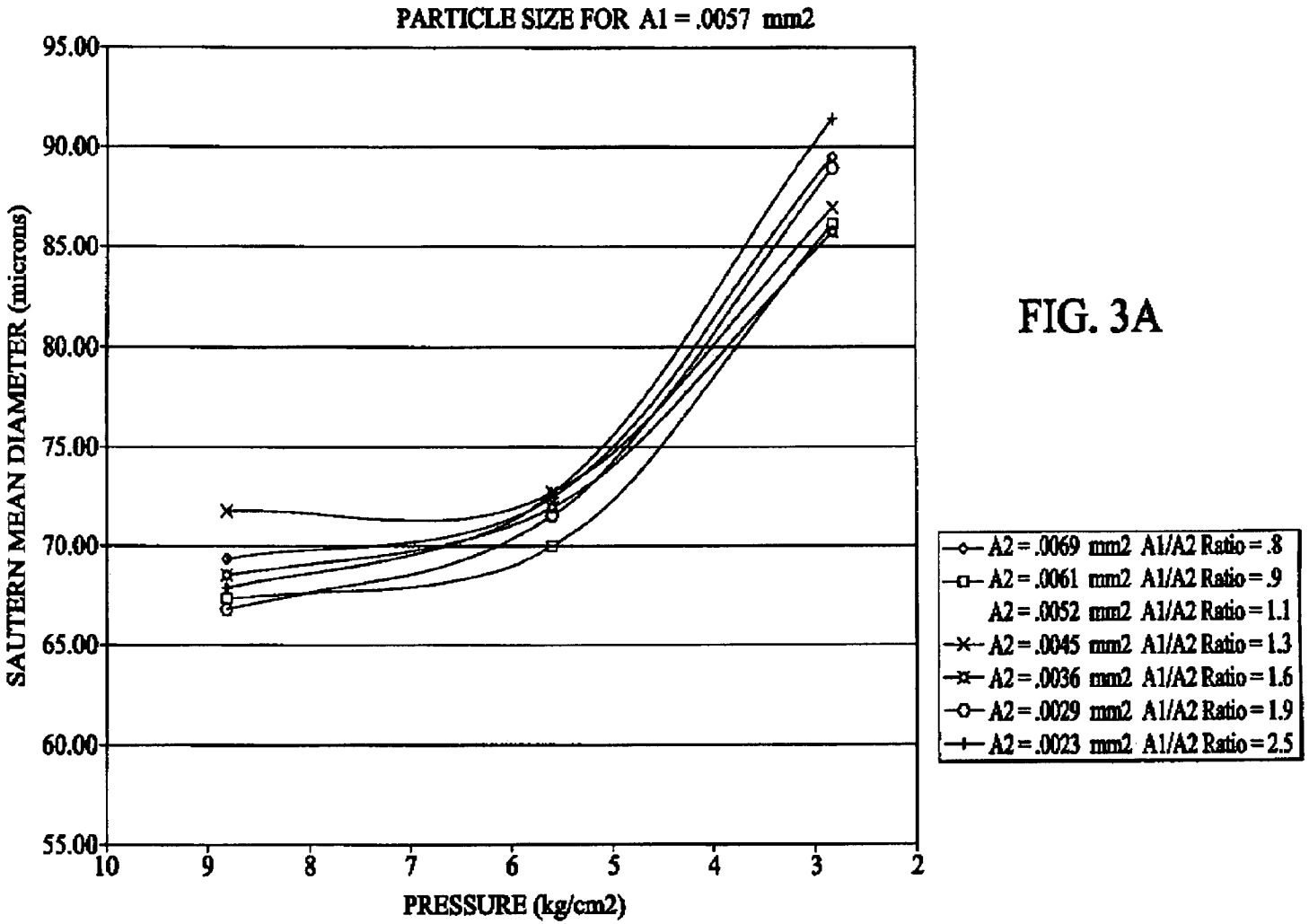
FIGS. 3A-3C are three-dimensional graphical representations of the interrelationship between three spray characteristics of a product being dispensed from a pressurized system for three different flow restriction areas.
Figure 4A:
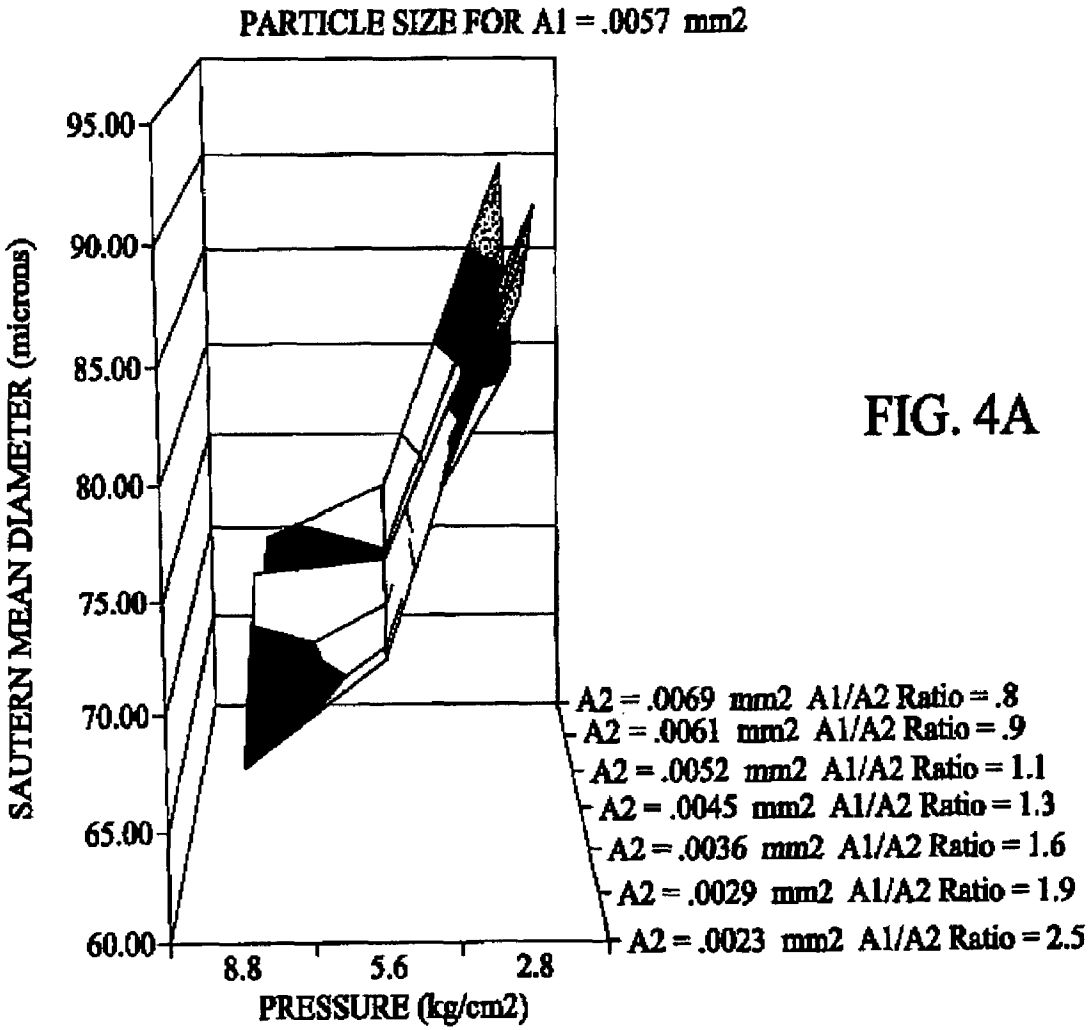
FIGS. 4A-4C are two-dimensional graphical representations of the information presented in FIGS. 3A-3C, respectively.

Referring to FIGS. 3A and 4A, a system having a upstream flow restriction of 0.006 square millimeters is considered. From a depressurization of 8.8 to 5.6 kg/square centimeter, a difference of approximately 1-5 microns in particle size occurs throughout the range of flow area ratios of 0.8-2.5. From a depressurization of 5.6 to 2.8 kg/square centimeter, a difference of approximately 11-17 microns in particle size occurs throughout the range of flow area ratios of 0.8-2.5. This relationship indicates better performance is obtained at higher pressures for a flow area ratio of 0.8-2.5.

For the flow restriction of 0.006 square millimeters, good results, i.e. differences in particle size of less than 5 microns appear to occur throughout the range of flow area ratios ranging from 0.8-2.5 for pressures ranging from 8.8 to 5.6 kg/square centimeter. Greater differences in particle size occur throughout the same range of flow area ratios for pressures less than 5.6 kg/square centimeter.

Figure 3B:
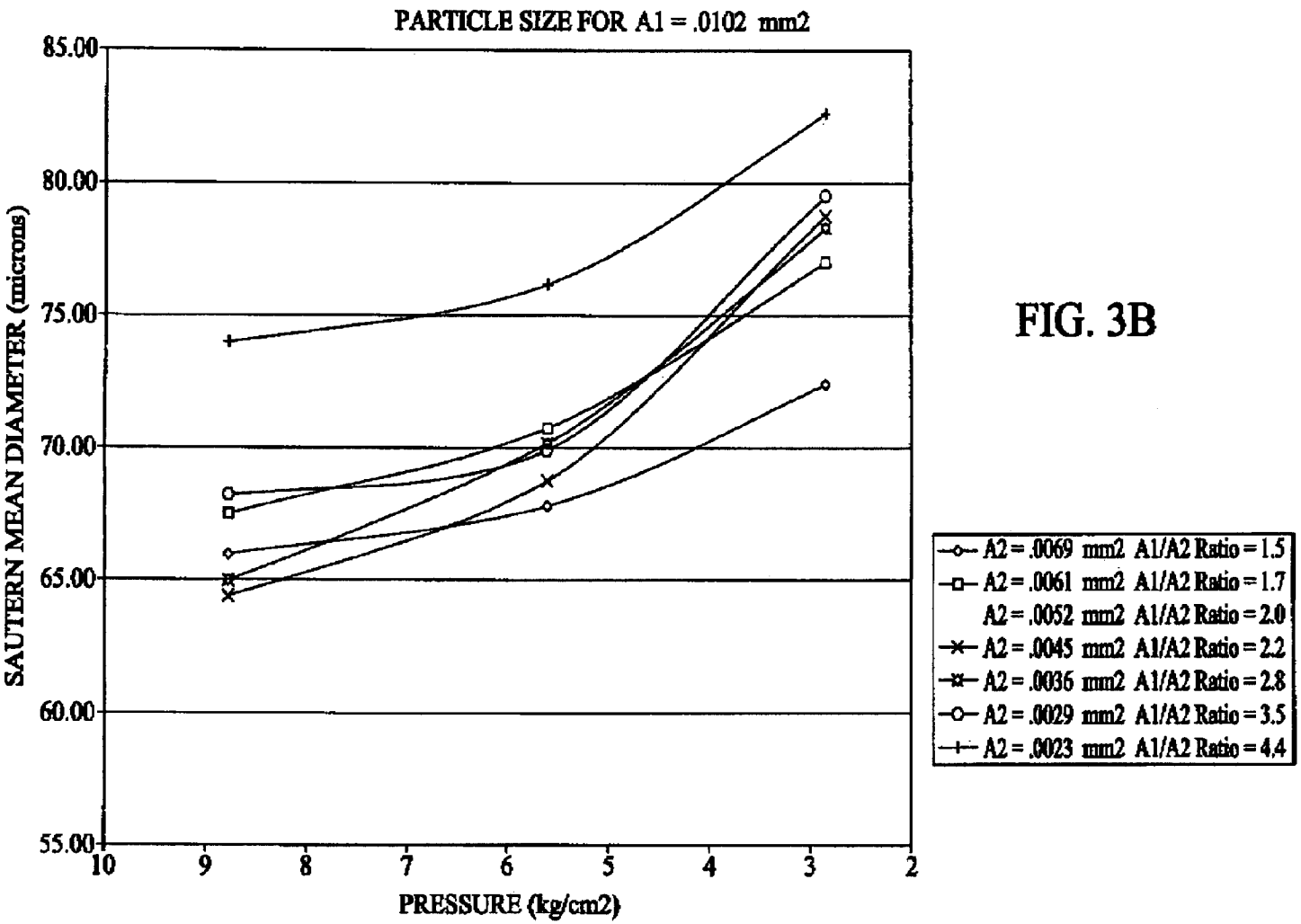
Figure 4B:
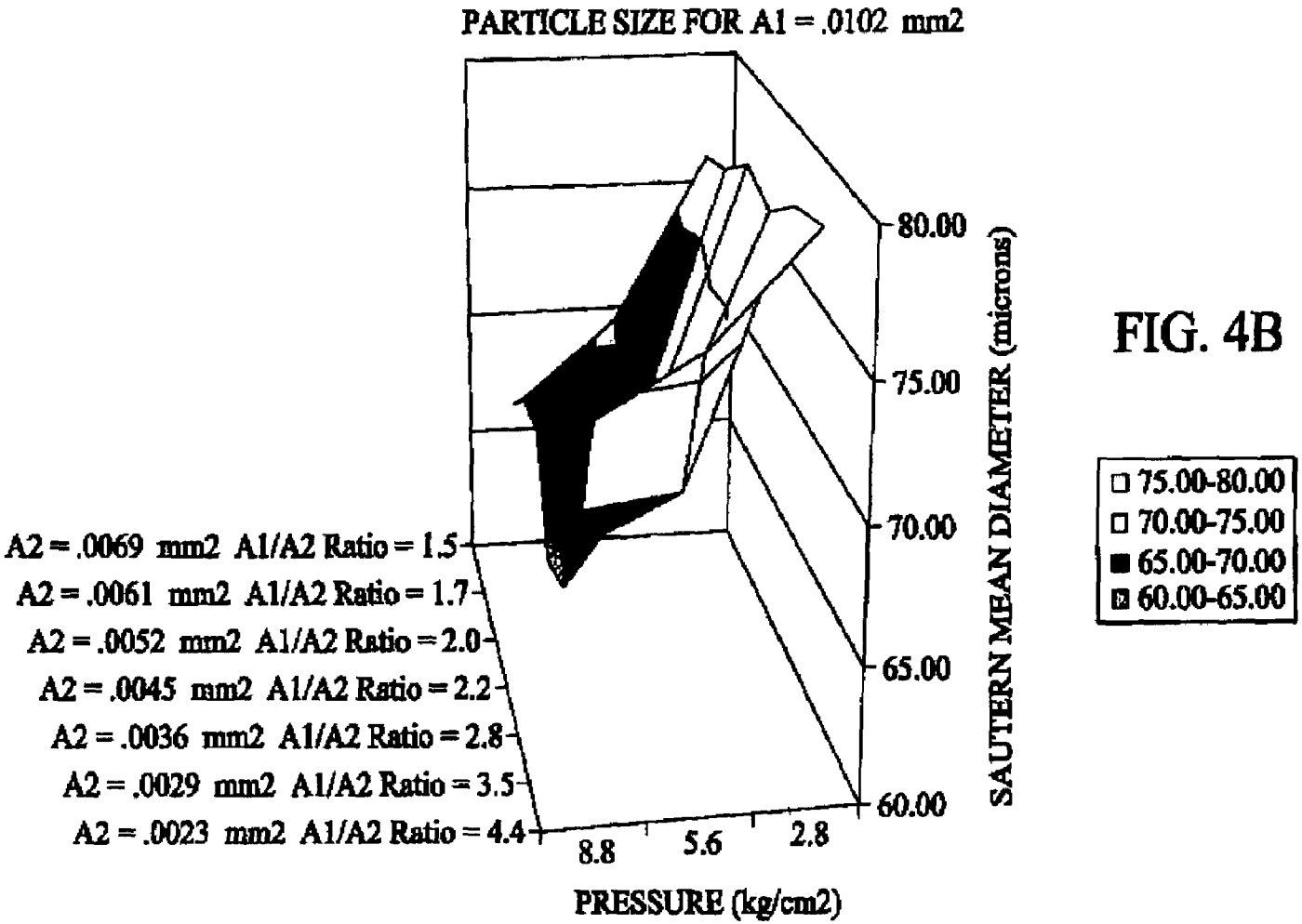

Referring to FIGS. 3B and 4B, a system having a upstream flow restriction of 0.010 square millimeters is considered. From a depressurization of 8.8 to 5.6 kg/square centimeter, a difference of approximately 1-5 microns in particle size occurs throughout the range of flow area ratios of 1.5-4.4. From a depressurization of 5.6 to 2.8 kg/square centimeter, a difference of approximately 5-10 microns in particle size occurs throughout the range of flow area ratios of 1.5-4.4. This relationship indicates better performance is obtained at higher pressures for a flow area ratio of 1.5-4.4.

For the flow restriction of 0.010 square millimeters, the best results appear to occur at flow area ratios less than 2.0. Such results are qualitatively better at relatively greater pressures.

Figure 3C:
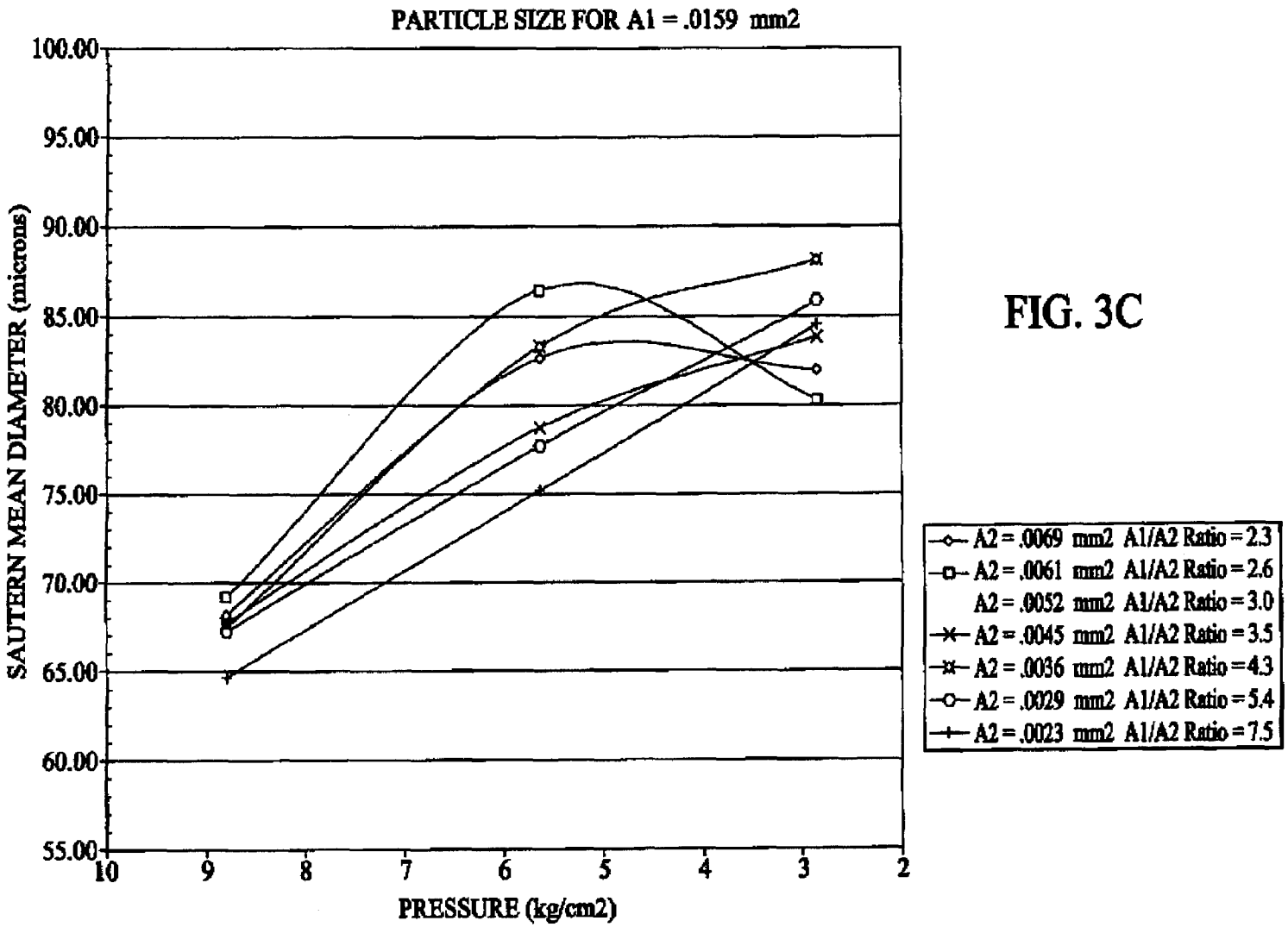
Figure 4C:
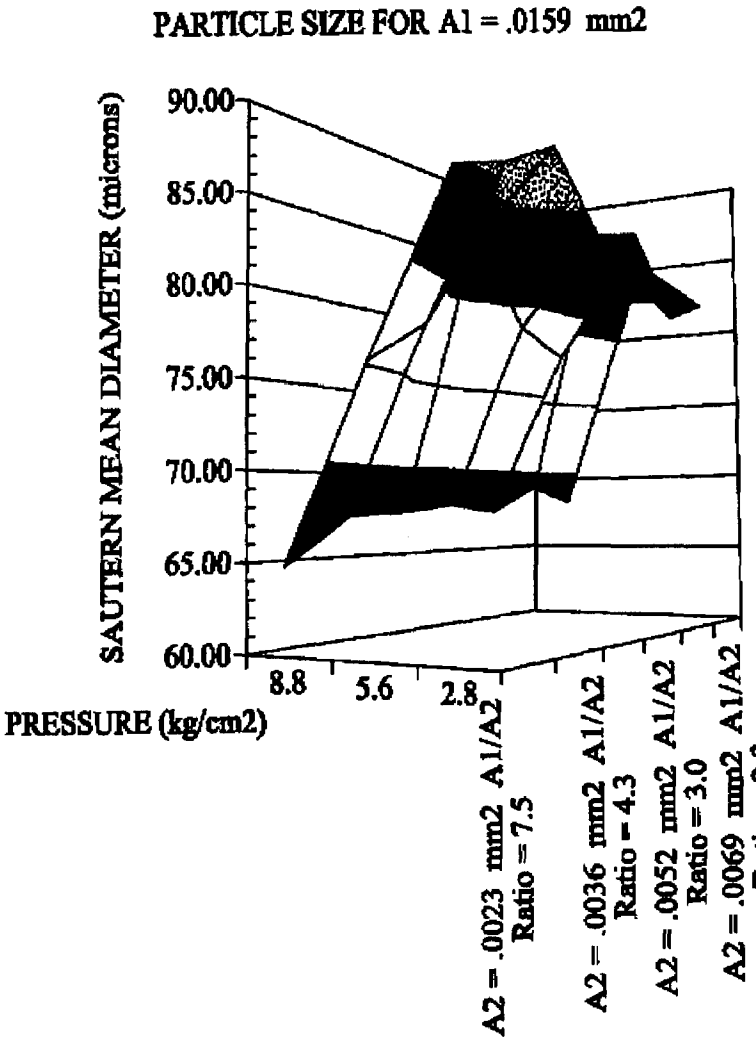

Referring to FIGS. 3C and 4C, a system having a upstream flow restriction of 0.016 square millimeters is considered. From a depressurization of 8.8 to 5.6 kg/square centimeter, a difference of approximately 10-20 microns in particle size occurs throughout the range of flow area ratios of 2.3-7.5. From a depressurization of 5.6 to 2.8 kg/square centimeter, a difference of approximately 5-10 microns in particle size occurs throughout the range of flow area ratios of 2.6-7.5, indicating a qualitative improvement throughout the range. A difference in particle size of approximately 1 micron occurs at the flow area ratio of 2.3.

For the flow area restriction of 0.016 square millimeters, the best results appear to be obtained at flow area ratios less than 2.5 and from about 3.5 to 4.3. Such results are qualitatively better at relatively lower pressures.

A difference in particle size of approximately 10 microns or less, and particularly approximately 5 microns or less is considered over an operative pressure range is considered to be relatively constant. The foregoing data, which illustrate a relatively constant particle size are shown in Table 1 below. Table 1 shows the upstream flow restriction in square millimeters for various flow area ratios of the area of the upstream flow restriction to the area of the tangentials 24 over a pressure range from 8.8-2.3 kg/square centimeters and useable to obtain a particle size difference of approximately 5 microns or less over such pressure range. Table 2 illustrates the same data for a particle size difference ranging from approximately 5-10 microns.

TABLE 1

| Pressure range (Kg/sq cm) | Flow area ratio 0.8-1.5 | Flow area ratio 1.5-2.5 | Flow area ratio 2.5-3.5 | Flow area ratio 3.5-4.3/4.4 |
|---|---|---|---|---|
| 8.8-5.6 | 0.006 | 0.006 | | |
| 8.8-5.6 | | 0.010 | 0.010 | 0.010 |
| 5.6-2.3 | | | | 0.016 |

TABLE 2

| Pressure range (Kg/sq cm) | Flow area ratio 1.5-2.3 | Flow area ratio 2.3-3.0 | Flow area ratio 3.0-4.4 | Flow area ratio 4.4-7.5 |
|---|---|---|---|---|
| 8.8-5.6 | | | 0.016 | 0.016 |
| 5.6-2.3 | | 0.016 | 0.016 | 0.016 |
| 5.6-2.3 | 0.010 | 0.010 | 0.010 | |

Thus, it appears that for many applications requiring only a 10 micron tolerance, a upstream flow restriction of 0.016, coupled with a flow area ratio of 2.3-7.5 at pressures from 5.6-2.3 kg/square centimeter and ranging from 3.0-7.5 for pressures of 8.8-5.6 kg/sq centimeter is suitable. If a smaller upstream flow restriction of 0.010 square millimeters is selected, this geometry would be usable with a flow area ratio of 1.5-4.4. If the application required a 5 micron tolerance, any of the entries in Table 1 would be suitable.

What is claimed is:

1. A package for dispensing contents therefrom over a predetermined pressure range and comprising:

a container for containing product therein, said container being internally pressurized, to a pressure ranging from 8.8-5.6 kg/square centimeters;

a reservoir for containing said product;

a valve stem for removing said product from said reservoir, said valve stem having an upstream flow restriction therein, said valve stem being movable from a closed first position to an open second position, said flow restriction having an area ranging from 0.006-0.016 square millimeters;

one or more tangentials for receiving product from said valve stem, said tangentials having a combined tangential flow area; and a swirl chamber for receiving a confluence of product from said tangentials and air to be mixed therewith;

a nozzle for dispensing contents from said container to the ambient in an axial direction, said nozzle being in fluid communication with said swirl chamber wherein the ratio of the combined flow area of said tangentials to said upstream flow restriction ranges from 0.8-7.5.

2. A container according to claim 1 wherein said tangentials are oriented perpendicular to said nozzle.

3. A container according to claim 2 comprising three tangentials spaced 120 degrees apart.

4. A container according to claim 3 wherein package has a longitudinal axis, and said movable valve stem is coincident said longitudinal axis, said upstream flow restriction comprising at least one valve port, said at least one valve port being disposed in said movable valve stem, and oriented orthogonal to said longitudinal axis.

5. A container according to claim 4 wherein said ratio ranges from 1.5-2.5.

6. A container according to claim 5 wherein said combined flow area of said tangentials ranges from 0.006-0.010 square millimeters.

7. A container according to claim 6 wherein said ratio is from 1.5-4.4.

8. A container according to claim 6 wherein said ratio is from 3.5-4.3.

9. A container according to claim 6 wherein said ratio is from 1.5-3.5.

10. A package for dispensing contents therefrom over a predetermined pressure range and comprising:

a container for containing product therein, said container being internally pressurized, to a pressure ranging from 5.6 to 2.3 kg/square centimeters;

a reservoir for containing said product;

a valve stem for removing said product from said reservoir, said valve stem having an upstream flow restriction therein, said valve stem being movable from a closed first position to an open second position, said flow restriction having an area ranging from 0.010-0.016 square millimeters;

one or more tangentials for receiving product from said valve stem, said tangentials having a combined tangential flow area; and a swirl chamber for receiving a confluence of product from said tangentials and air to be mixed therewith; a nozzle for dispensing contents from said container to the ambient in an axial direction, said nozzle being in fluid communication with said swirl chamber wherein the ratio of the combined flow area of said tangentials to said upstream flow restriction ranges from 1.5-4.4.

11. A container according to claim 10 comprising three tangentials spaced 120 degrees apart and oriented perpendicular to said nozzle.

12. A container according to claim 11 wherein package has a longitudinal axis, and said movable valve stem is coincident said longitudinal axis, said upstream flow restriction comprising at least one valve port, said at least one valve port being disposed in said movable valve stem, and oriented orthogonal to said longitudinal axis.

13. A container according to claim 12 wherein said combined flow area of said tangentials is about 0.010 square millimeters.

14. A container according to claim 10 wherein said ratio is from 2.3-4.4.

15. A container according to claim 10 wherein said ratio is from 1.5-2.3.

16. A container according to claim 12 wherein said ratio is from 3.5-4.4.

* * * * *